US008708128B2

(12) United States Patent
Tomizawa

(10) Patent No.: US 8,708,128 B2
(45) Date of Patent: Apr. 29, 2014

(54) PAPER CURRENCY DEPOSIT-WITHDRAWAL MECHANISM

(75) Inventor: Katsuyoshi Tomizawa, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/990,788

(22) PCT Filed: Jan. 13, 2012

(86) PCT No.: PCT/JP2012/050611

§ 371 (c)(1),
(2), (4) Date: May 30, 2013

(87) PCT Pub. No.: WO2012/132496

PCT Pub. Date: Oct. 4, 2012

(65) Prior Publication Data

US 2013/0248320 A1 Sep. 26, 2013

(30) Foreign Application Priority Data

Mar. 30, 2011 (JP) ..... 2011-075146

(51) Int. Cl.
*G07F 7/04* (2006.01)

(52) U.S. Cl.
USPC ..... 194/206; 382/135

(58) Field of Classification Search
USPC ..... 194/206, 207; 209/534; 382/135
See application file for complete search history.

(56) References Cited

U.S. PATENT DOCUMENTS

| | | | | |
|---|---|---|---|---|
| 2002/0092905 | A1* | 7/2002 | Katou et al. | 235/379 |
| 2004/0182678 | A1* | 9/2004 | Ina et al. | 194/207 |
| 2006/0043167 | A1* | 3/2006 | Fujioka | 235/379 |
| 2009/0152805 | A1* | 6/2009 | Nomiyama et al. | 271/227 |

FOREIGN PATENT DOCUMENTS

| | | | |
|---|---|---|---|
| JP | H4-37983 | | 2/1992 |
| JP | 2010-117803 | A | 5/2010 |
| JP | 2010-191881 | A | 9/2010 |
| JP | 2010-231784 | A | 10/2010 |
| JP | 2010-287073 | A | 12/2010 |

* cited by examiner

*Primary Examiner* — Jeffrey Shapiro
(74) *Attorney, Agent, or Firm* — Rabin & Berdo, P.C.

(57) ABSTRACT

Provided is a means whereby improvement in fund efficiency of stored paper currency of a paper currency storage vault and reduction in withdrawal processing time are effected, and whereby a count value of a number of stored sheets and an actual number of sheets are matched. An accumulation order table, which stores an accumulation order of paper currency which is stored in a paper currency storage vault (8) and serial number information of the paper currency in accumulation sequence, is stored in a storage unit of a paper currency deposit-withdrawal mechanism (1). When making a withdrawal, if the paper currency which is dispensed from the paper currency storage vault (8) is withdrawal anomaly paper currency which is differentiated with a differentiation unit (6) as a conveyance anomaly, the serial number information of the next successive paper currency of the withdrawal anomaly paper currency is detected by the differentiation unit (6). Based on the detected serial number information and the accumulation order table, a corrected number of sheets, which is the number of sheets of paper currency which configures the withdrawal anomaly paper currency, is counted, the corrected number of sheets is subtracted from the current count of the stored number of sheets of the paper currency storage vault (8), the current stored number of sheets is corrected, and the withdrawal anomaly paper currency of the counted corrected number of sheets is conveyed to and accumulated in a deposit-withdrawal unit (5).

6 Claims, 7 Drawing Sheets

FIG.3

| STACKING SEQUENCE INDICATOR | SERIAL NUMBER DATA | |
|---|---|---|
| | SERIAL NUMBER | SERIAL NUMBER COLOR |
| 100 | A000001A | BLACK |
| 99 | A000001N | BLACK |
| 98 | A000001T | BLUE |
| 97 | A000001B | BROWN |
| 96 | A000001A | BLUE |
| 95 | A000001P | BLACK |
| 94 | A000001G | BLUE |
| 93 | A000001A | BROWN |
| 92 | A000001A | BROWN |
| 91 | A000001Z | BLACK |
| 90 | A000001S | BLACK |
| ⋮ | ⋮ | ⋮ |
| 1 | A002001K | BLUE |

PAPER CURRENCY DEPOSIT-WITHDRAWAL MECHANISM

TECHNICAL FIELD

The present invention relates to a paper currency deposit-withdrawal mechanism employed in an automated transaction apparatus such as an automated teller machine installed in a branch of for example a financial institution.

BACKGROUND ART

In a known paper currency deposit-withdrawal mechanism, during a pay-in transaction a regular banknote, which is an introduced banknote classified as a genuine note by a classification section, is stored in a denomination-specific banknote storage box whilst incrementing a stored note count. During a pay-out transaction, banknotes of denomination(s) that configure the payment amount are fed out from the corresponding banknote storage boxes one note at a time. These banknotes are classified by the classification section, and regular banknotes classified as genuine notes are conveyed to a paying in/paying out section and stacked whilst decrementing the stored note count of the banknote storage box. When all of the banknotes configuring the payment amount have been stacked at the paying in/paying out section, the banknotes are paid out to the customer. During pay-out, banknotes classified by the classification section as having conveyance irregularities such as overlapping travel or chains are conveyed to a reject box as reject banknotes and stacked, even if they are regular banknotes (see for example Japanese Patent Application Laid-Open (JP-A) No. 2010-287073 (paragraphs 0043 to 0054, 0068 to 0072, and FIG. 4)).

DISCLOSURE OF INVENTION

Technical Problem

However, in the known technology described above, even if a banknote was classified as a regular banknote during pay-in and stored in the banknote storage box, during pay-out, a pay-out irregular banknote with which conveyance irregularities such as overlapping travel have occurred, due to for example irregularities in a feeding out operation from the banknote storage box, is stacked in the reject box as a reject banknote. There are accordingly issues with poor cash utilization efficiency of banknotes stored in the banknote storage boxes, and also for example delays occurring in pay-out processing times.

Moreover, since it is not possible to accurately count the number of pay-out irregular banknotes in which conveyance irregularities have occurred, differences arise between the count values of stored note counts for the banknote storage boxes and the actual number of notes. It is therefore necessary to re-count the stored note count of the banknote storage boxes during auditing, with the issue that a long operation time is required during audits.

In order to address the above issues, an object of the present invention is to achieve an improvement in the banknote storage cash utilization efficiency for a banknote storage box and achieve a reduction in pay-out processing time, and also to provide a way to make the count value of a stored note count match the actual number of notes.

Solution to Problem

In order to address the above issues, in the present invention, a paper currency deposit-withdrawal mechanism includes a paying in/paying out section that accepts a banknote introduced by a customer during pay-in and stacks a banknote to be paid out to a customer during pay-out, a classification section that performs various classifications on a banknote, a banknote storage box that stores a banknote employed in pay-out, a conveyance path that conveys a banknote, and a storage section stored with a stacking sequence table that stores, in stacking sequence, a stacking sequence indicator of a banknote stored in the banknote storage box and serial number data of the banknote, the paper currency deposit-withdrawal mechanism further including: a stored note count counting section that counts a current stored note count of banknotes stored in the banknote storage box; a detection section that, during pay-out, when a banknote fed out from the banknote storage box is a pay-out irregular banknote(s) classified by the classification section as having a conveyance irregularity, detects the serial number data of a next subsequent banknote following the pay-out irregular banknote(s); a correction note count section that, based on the detected serial number data and the stacking sequence table, counts a correction note count that is a number of banknotes configuring the pay-out irregular banknote(s); a correction section that corrects the current stored note count by reducing the count number of the current stored note count of the banknote storage box by the correction note count; and a conveying and stacking section that conveys a pay-out irregular banknote(s) for which the correction note count has been counted to the paying in/paying out section with the conveyance path and stacks the pay-out irregular banknote(s).

Advantageous Effects of Invention

The present invention accordingly obtains the advantageous effects of being capable of stacking pay-out irregular banknotes for which the correction note count has been counted at the paying in/paying out section, thereby reducing the number of banknotes fed out from the banknote storage box during pay-out, and also achieving an improvement in cash utilization efficiency of the banknote storage box and a reduction in pay-out transaction times. It is also possible to reliably match the count value of the stored note count of the banknote storage box with the actual number of notes, thereby enabling the operation time of an audit to be greatly shortened.

BRIEF DESCRIPTION OF DRAWINGS

FIG. 3 is an explanatory diagram illustrating a configuration example of a stacking sequence table of the first exemplary embodiment.

BEST MODE FOR CARRYING OUT THE INVENTION

Explanation follows regarding exemplary embodiments of a paper currency deposit-withdrawal mechanism according to the present invention, with reference to the drawings.

First Exemplary Embodiment

Figure 1:
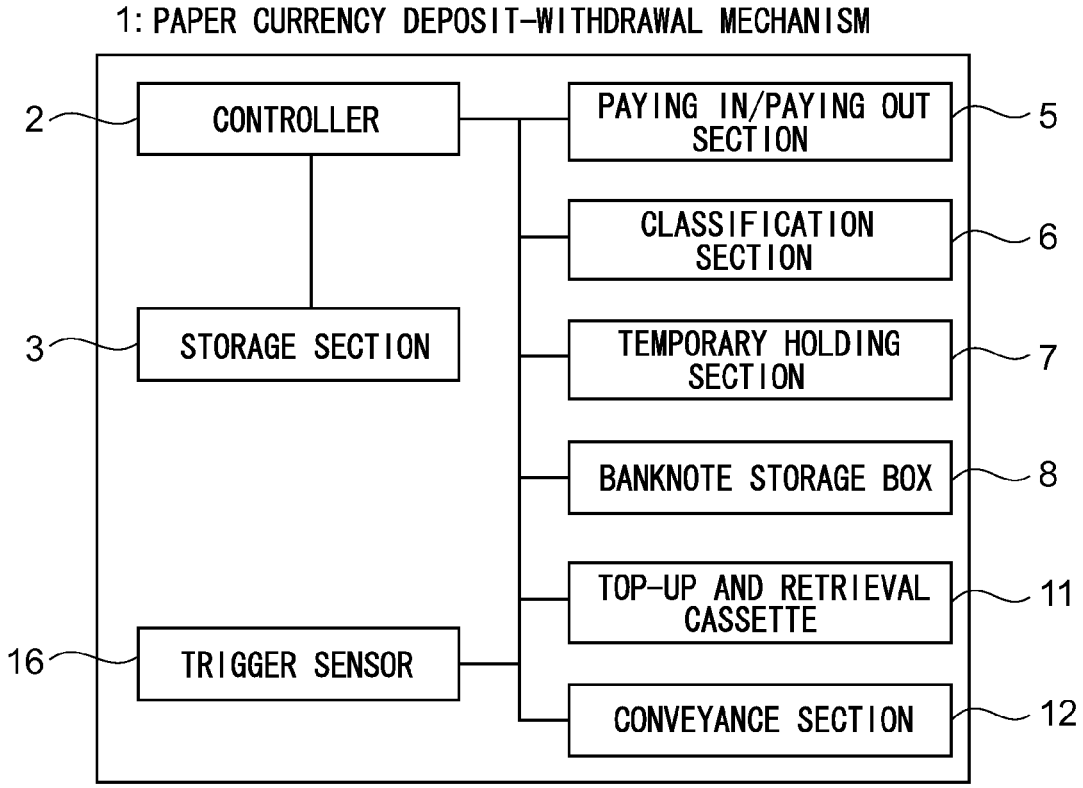
FIG. 1 is a block diagram illustrating a paper currency deposit-withdrawal mechanism of a first exemplary embodiment.
Figure 2:
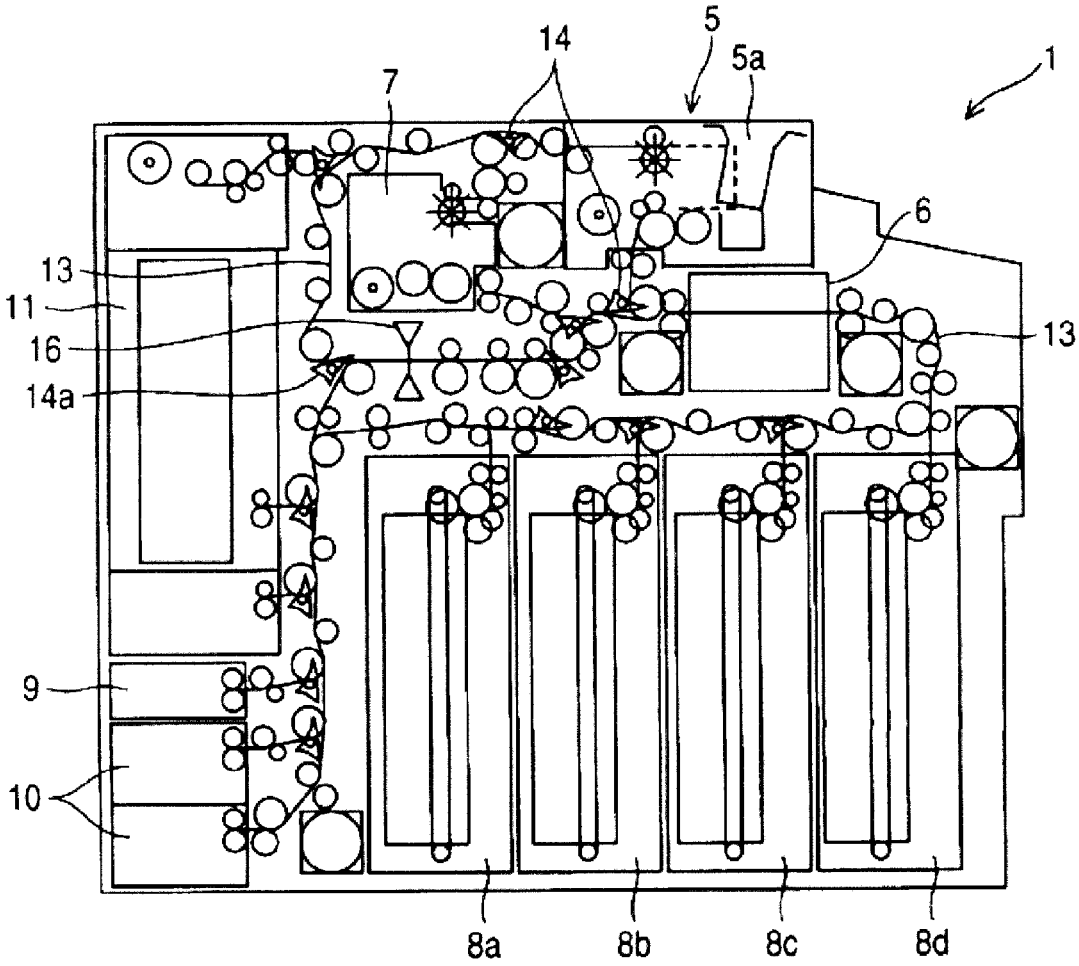
FIG. 2 is an explanatory diagram illustrating a configuration of a paper currency deposit-withdrawal mechanism of the first exemplary embodiment.

A paper currency deposit-withdrawal mechanism 1 illustrated in FIG. 1 and FIG. 2 has functions including, for example, accepting banknotes introduced by a customer, classifying, counting and storing these banknotes, and counting and paying out to a customer banknotes to be paid out to a customer, and is configured as follows.

A controller 2 of the paper currency deposit-withdrawal mechanism 1 has functions including controlling each section in the paper currency deposit-withdrawal mechanism 1 based on instructions from a higher-level apparatus such as an automated teller machine, and performing for example banknote processing such as banknote take-in processing, storage processing, and pay-out processing.

A storage section 3 of the paper currency deposit-withdrawal mechanism 1 is stored for example with a program executed by the controller 2, various data employed by the program, and processing results of the controller 2.

A paying in/paying out section 5 is provided to the front face side of the paper currency deposit-withdrawal mechanism 1 and includes a paying in/paying out port 5*a* provided with a shutter that opens and closes during the introduction of banknotes by a customer and during disbursement of banknotes to a customer, and a separation and stacking mechanism that separates banknotes that have been introduced through the paying in/paying out port 5*a* into individual notes and feeds out the individual notes, and also stacks for example pay-out banknotes to be paid out to a customer.

A classification section 6 has functions including, for example: a function of performing various classifications of conveyed banknotes, namely of identifying whether a banknote is genuine or counterfeit, whole or damaged, and identifying the denomination of the banknote, for example; a function of detecting conveyance irregularities such as overlapping travel or chains, and a function of detecting serial numbers and the serial number colors of conveyed banknotes using for example a character recognition function such as Optical Character Recognition (OCR).

A temporary holding section 7 is a stacking section that stacks and temporarily holds regular banknotes that are banknotes introduced to the paying in/paying out section 5 in pay-in processing and that have been classified as genuine notes by the classification section 6 and determined to be eligible for take-in processing. The temporary holding section 7 includes a separation and stacking mechanism that separates and feeds out banknotes one note at a time and stacks conveyed banknotes.

Banknote storage boxes 8 are storage boxes that store regular banknotes employed in pay-out by denomination according to set denominations. The banknote storage boxes 8 include a separation and stacking mechanism that separates and feeds out banknotes one note at a time and stacks conveyed banknotes.

Four of the banknote storage boxes 8, banknote storage boxes 8*a* to 8*d*, are provided in the present exemplary embodiment. The banknote storage boxes 8*a* to 8*d* are respectively provided with separation and stacking mechanisms that discharge conveyed banknotes from an upper portion and stack the banknotes, and feed out banknotes in order from the uppermost stacked banknote.

A forgotten banknote storage box 9 is a storage box that stores banknotes that have been forgotten and left behind in the paying in/paying out section 5 by a customer during a pay-in transaction or a pay-out transaction. The forgotten banknote storage box 9 includes a stacking mechanism that stacks conveyed banknotes.

A reject box 10 is a storage box that stacks for example banknotes classified with conveyance irregularities such as overlapping conveyance by the classification section 6 during storing of taken-in banknotes in a pay-in transaction, or when storing reject banknotes that have been classified as damaged notes that are not suitable for pay-out. The reject box 10 includes a stacking mechanism that stacks conveyed banknotes.

A top-up and retrieval cassette 11 is detachably mounted to the paper currency deposit-withdrawal mechanism 1. The top-up and retrieval cassette 11 is a cassette that stores banknotes for topping up each of the banknote storage boxes 8, banknotes that cannot to be stored in the banknote storage boxes 8 and banknotes retrieved from each of the banknote storage boxes 8. The top-up and retrieval cassette 11 is equipped with a separation and stacking mechanism that separates and feeds out banknotes one note at a time and stacks conveyed banknotes.

A conveyance section 12 has functions including, for example, a function of driving conveyance paths 13 that convey banknotes gripped by for example belts or rollers, and a function of driving switching mechanisms 14 such as switching blades that switch the conveyance direction of a banknote, that are provided at each branch portion of the conveyance paths 13.

A trigger sensor 16 is an optical sensor configured by a light emission section and a light reception section disposed facing each other across the conveyance path 13. The trigger sensor 16 has a function of detecting a banknote when the light reception section detects that light from the light emission section is being blocked by a banknote. During pay-out, the trigger sensor 16 detects a timing to make determination as to whether the stacking destination of a banknote that has been classified by the classification section 6 should be sent to the paying in/paying out section 5 or the reject box 10.

A switching mechanism 14*a* (see FIG. 2) of the present exemplary embodiment switches the conveyance direction of a banknote between the direction of the paying in/paying out section 5 and the direction of the reject box 10 based on the determination made during banknote detection by the trigger sensor 16.

The trigger sensor 16 is provided on the conveyance path 13 that connects together the classification section 6 and the paying in/paying out section 5. The length (referred to as conveyance path length) of the conveyance path between the classification section 6 and the trigger sensor 16 is configured so as to be longer than the conveyance pitch of banknotes fed out from the banknote storage boxes 8 during pay-out.

The storage section 3 of the paper currency deposit-withdrawal mechanism 1 of the present exemplary embodiment is pre-stored with a service execution program. The service execution program is a banknote processing program that, according to an instruction from a higher-level apparatus, functions to execute banknote processing such as banknote pay-out processing in a pay-out transaction and banknote pay-in processing in a pay-in transaction, with an additional irregular banknote count counting program that functions to count the number of pay-out irregular banknotes as a correction note count when the classification section 6 has classified conveyed banknotes with conveyance irregularities such as overlapping conveyance or chains in the case of pay-out processing. Each functional means of the paper currency deposit-withdrawal mechanism 1 of the present exemplary embodiment is configured by the steps of the service execution program that is executed by the controller 2.

Storage denomination setting data that sets the denominations that are to be stored associated with each of the banknote storage boxes 8 is preset and stored in the storage section 3. The following areas, for example, are also secured in advance in the storage section 3: a stored note count counting area for counting a stored note count of banknotes stored in the banknote storage boxes 8 separately for each of the banknote storage boxes 8; a table storage area for a stacking sequence table for each of the banknote storage boxes 8 that stores serial number data of banknotes stacked in each of the banknote storage boxes 8; a correction note count counting area for counting as the correction note count the number of pay-out irregular banknotes with which conveyance irregularities such as overlapping conveyance have occurred during pay-out; and a stacked payment note count counting area for counting by denomination a stacked payment note count of stacked banknotes in the paying in/paying out port 13*a* during pay-out.

As shown in FIG. 3, a stacking sequence table of the present exemplary embodiment is stored with a stacking sequence indicator for each banknote, and serial number data of the serial numbers and the serial number colors of each of the banknotes, stored in stacking sequence. Note that "serial number" refers to the serial number that identifies an individual banknote. For example, in the case of notes issued by the Bank of Japan, the serial number refers to the serial number printed on the banknote for identifying the individual banknote, the serial number consisting of one or two Roman letters, six Arabic numerals, and one Roman letter at the end. When these combinations of serial numbers have been used up for banknotes of the same printing pattern, the print color of the serial number (referred to as the serial number color) is varied. In the case of notes issued by the Bank of Korea, the serial number is configured by three Roman letters and seven Arabic numerals, and in the case of Euro banknotes the serial number is configured by one or plural Roman letters and Arabic numerals.

Explanation follows regarding a processing operation for a top-up process when topping up each of the banknote storage boxes 8 of the paper currency deposit-withdrawal mechanism 1 of the present exemplary embodiment with banknotes from the top-up and retrieval cassette 11, using Bank of Japan issued notes as an example.

When topping up banknotes from the top-up and retrieval cassette 11, the top-up and retrieval cassette 11 is mounted to the paper currency deposit-withdrawal mechanism 1. The controller 2 then feeds banknotes from the top-up and retrieval cassette 11 one note at a time and conveys the banknotes to the classification section 6 with the conveyance path 13. For a regular banknote that has been classified as a genuine note and a whole note by the classification section 6, the banknote storage box 8 set for the corresponding denomination is designated by referring to the storage denomination setting data of the storage section 3 based on the denomination of the banknote. The banknote is then conveyed by the conveyance path 13 to the designated banknote storage box 8 and stored, and a stored note count is counted for the stored banknotes, separately for each of the banknote storage boxes 8 in the stored note count counting area of the storage section 3.

When this occurs, the controller 2 uses the classification section 6 to detect the serial number data of the conveyed banknotes, and stores the serial number data associated with the stacking sequence indicator whilst incrementing (increasing by one) the stacking sequence indicator of the stacking sequence table in the storage section 3 for the corresponding banknote storage box 8.

Note that banknotes classified with conveyance irregularities such as overlapping conveyance by the classification section 6 are conveyed by the conveyance path 13 to a storage section at a lower portion of the top-up and retrieval cassette 11 and stacked.

The processing operation for the top-up process of banknotes from the top-up and retrieval cassette 11 in the paper currency deposit-withdrawal mechanism 1 of the present exemplary embodiment is performed as described above.

When performing pay-in processing in a pay-in transaction according to the paper currency deposit-withdrawal mechanism 1 of the present exemplary embodiment, on receipt of a pay-in instruction from a higher-level apparatus, the controller 2 opens the shutter of the paying in/paying out section 5. When banknotes are introduced into the paying in/paying out port 5*a*, the shutter closes and the banknotes that have been introduced to the paying in/paying out port 5*a* are fed out one note at a time and conveyed to the classification section 6 by the conveyance path 13. Notes classified as genuine notes by the classification section 6 are conveyed to the temporary holding section 7 by the conveyance path 13 and stacked. Pay-in reject banknotes classified as pay-in reject banknotes by the classification section 6, for example due to being of indeterminate denomination, are conveyed to the paying in/paying out section 5 by the conveyance path 13 and returned to the customer.

When the pay-in amount is confirmed by the higher-level apparatus, the controller 2 feeds out the confirmed banknotes stacked in the temporary holding section 7 and conveys the banknotes to the classification section 6 by the conveyance path 13. For a regular banknote that has been classified as a genuine note and a whole note by the classification section 6, the banknote storage box 8 set for the corresponding denomination is designated by referring to the storage denomination setting data of the storage section 3 based on the denomination of the banknote. The banknote is then conveyed by the conveyance path 13 to the designated banknote storage box 8 and stored, and a stored note count is counted of the stored banknotes for each of the banknote storage boxes 8 in the stored note count counting area of the storage section 3.

The controller 2 uses the classification section 6 to detect the serial number data of the serial number and number color of the conveyed banknote, and stores the serial number data associated with the stacking sequence indicator whilst incrementing the stacking sequence indicator of the stacking sequence table of the corresponding banknote storage box 8.

Note that when storing banknotes in the banknote storage boxes 8, banknotes classified by the classification section 6 with conveyance irregularities such as overlapping conveyance, and banknotes classified for example as damaged notes that, although genuine notes for which denomination determination is possible, cannot be employed for pay-out due to excessive soiling or excessive damage, are conveyed to the reject box 10 by the conveyance path 13 and stacked.

The processing operation of pay-in processing of the paper currency deposit-withdrawal mechanism 1 of the present exemplary embodiment is performed as described above.

As described above, the stacking sequence indicators of stored banknotes and the serial number data of the banknotes are stored in stacking sequence to the stacking sequence table for each of the banknote storage boxes 8 in the table storage area of the storage section 3.

Note that the stored note count of each of the banknote storage boxes 8 in the present exemplary embodiment matches the highest number of the stacking sequence indicators in the stacking sequence table, that is to say, matches the stacking sequence indicator of the uppermost banknote.

Figure 4:
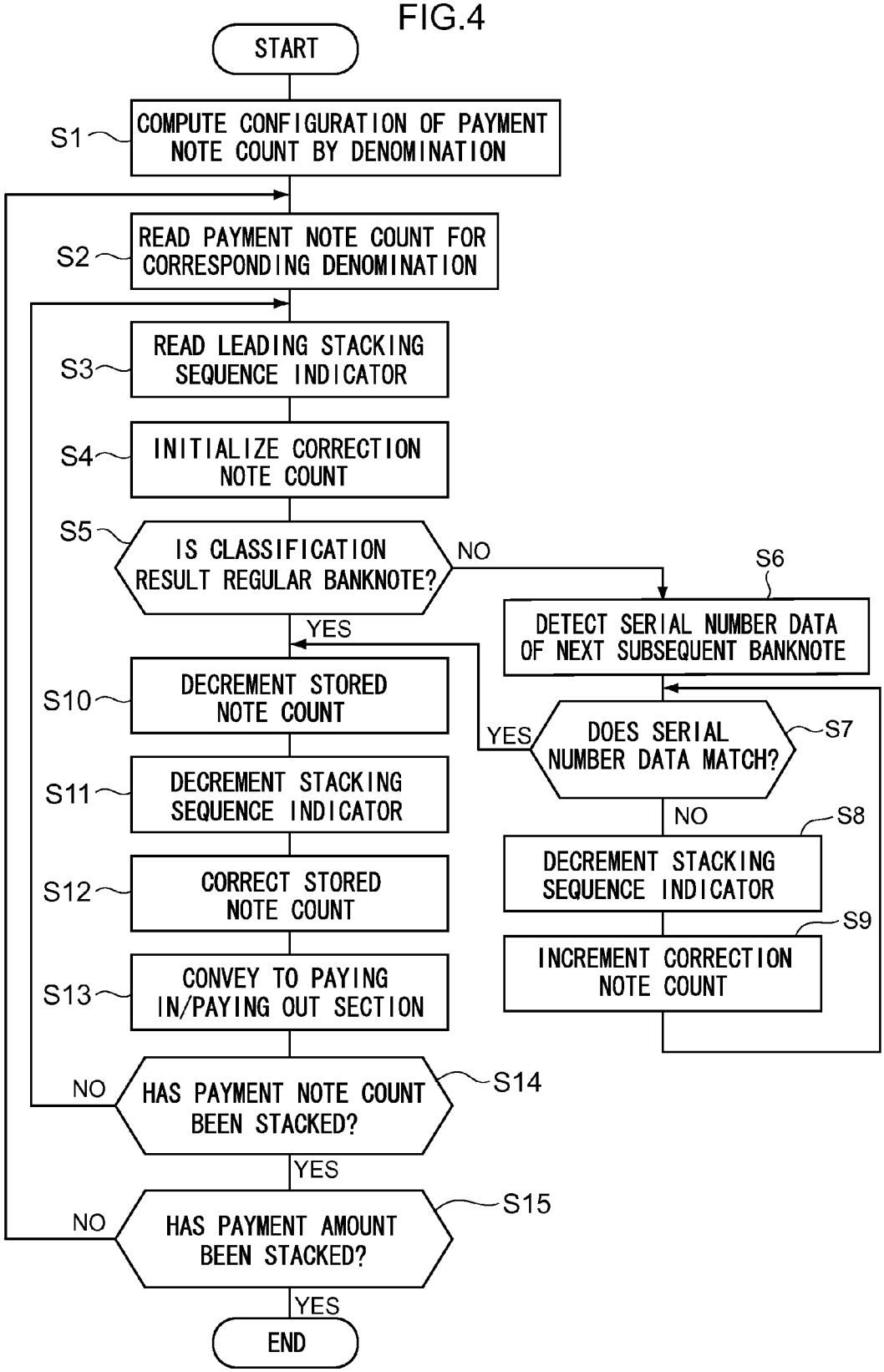
FIG. 4 is a diagram illustrating a flowchart that explains pay-out processing in the first exemplary embodiment.

Explanation follows regarding processing operation of pay-out processing for payment of banknotes stored in each of the banknote storage boxes 8 to a customer, with reference to the steps indicated by S in FIG. 4.

S1: The controller 2 of the paper currency deposit-withdrawal mechanism 1 receives a pay-out instruction with an attached pay-out amount from the higher-level apparatus, then computes a payment note count by banknote denomination that configures the payment amount, and saves the payment note count by denomination to the storage section 3.

S2: The controller 2 reads one denomination and the payment note count for that denomination from the payment note count by denomination saved in the storage section 3 and transitions to step S3.

S3: The controller 2 refers to the storage denomination setting data of the storage section 3 to designate the banknote storage box 8 for the read denomination, reads the leading stacking sequence indicator (in the present exemplary embodiment, the highest number out of the stacking sequence indicators, this being "100" in the example in FIG. 4) from the stacking sequence table for the corresponding banknote storage box 8, and saves this stacking sequence indicator in the storage section 3 as the current stacking sequence indicator.

S4: The controller 2 initializes the correction note count by setting 0 as the correction note count of the correction note count counting area of the storage section 3.

S5: When the correction note count has been initialized, the controller 2 feeds out and conveys the payment note count of banknotes for the corresponding denomination from the corresponding banknote storage box 8 to the classification section 6 at a specific conveyance pitch with the conveyance path 13. The denomination and any conveyance irregularities such as overlapping conveyance of the conveyed banknotes are classified by the classification section 6.

The controller 2 transitions to step S10 if a classification result is that a banknote is a genuine note of the corresponding denomination, and is a regular banknote. Transition is made to step S6 if a classification result is that a banknote is a pay-out irregular banknotes with conveyance irregularities.

S6: When the controller 2 has identified a conveyed banknote as a pay-out irregular banknotes, the pay-out irregular banknotes is conveyed as it is out of the classification section 6, and while the pay-out irregular banknotes is present on the conveyance path 13 between the classification section 6 and the trigger sensor 16, classification of the next subsequent banknote that has been conveyed to the classification section 6 is performed, and the serial number data of the subsequent banknote is detected.

S7: When the controller 2 has detected the serial number data of the subsequent banknote, the serial number data of the current stacking sequence indicator saved in the storage section 3 is compared with the detected serial number data of the subsequent banknote, and processing transitions to step S10 if the serial number data matches. Processing transitions to step S8 if the serial number data does not match.

S8: When it has been determined that the serial number data does not match, the controller 2 decrements (reduces by 1) the stacking sequence indicator saved in the storage section 3 to update the current stacking sequence indicator, and processing transitions to step S9.

S9: Next, the controller 2 increments the correction note count in the correction note count counting area of the storage section 3 and counts the correction note count, and processing returns to step S7. The processing operation from step S7 to step S9 is repeated until the serial number data of the subsequent banknote detected at step S6 matches the serial number data for the current stacking sequence indicator updated at step S8. Processing transitions to step S10 if the two serial number data mentioned above are matched.

For example, when at step S6 pay-out irregular banknotes occur that are configured by two banknotes wherein the first banknote to be paid out (the banknote with stacking sequence indicator 100 in FIG. 3) is classified with overlapping conveyance, these two pay-out irregular banknotes are conveyed out as they are and the serial number data of the subsequent banknote that follows (the third banknote with the stacking sequence indicator 98) is detected.

Then at step S7, the serial number data of the third banknote (Serial Number: A000201T, Serial Number Color: Blue) is compared against the serial number data of the current stacking sequence indicator (at this stage, the stacking sequence indicator 100) saved in the storage section 3. Since the serial number data does not match, at step S8 the current stacking sequence indicator is set to 99 (=100−1) and at step S9 the correction note count is set to 1 (=0+1). At step S7 the serial number data is compared again. Since there is no match with the serial number data of the third banknote, at step S8 and step S9 the current stacking sequence indicator is set to 98 (=99−1) and the correction note count is set to 2 (=1+1). Since there is a match when the serial number data is compared once again, processing transitions to step S10. Since at this point the correction note count is 2, the number of notes of the two banknotes classified with overlapping conveyance can be counted correctly.

In this way, the correction note count that is the number of banknotes configuring a pay-out irregular banknotes is counted by searching whilst sequentially decreasing the stacking sequence indicator of the stacking sequence table, based on the detected serial number data of the next subsequent banknote.

S10: When at step S5 regular banknote determination has been made, or when at S7 the serial number data has been determined to match, the controller 2 decrements by 1 the stored note count for the corresponding banknote storage box 8 in the stored note count counting area of the storage section 3. The current stored note count, reduced due to feeding out a banknote, is updated and processing transitions to step S11.

S11: Next, the controller 2 decrements by 1 the stacking sequence indicator saved in the storage section 3. The current stacking sequence indicator is updated and processing transitions to step S12.

S12: When the stored note count and the stacking sequence indicator have been updated, the controller 2 reduces the updated current stored note count by the correction note count in the correction note count counting area to correct the current stored note count, and processing transitions to S13.

When processing has transitioned from step S5, since the correction note count is 0 (see step S4) the stored note count remains at the current stored note count that was updated at step S10, namely 99 (=100−1) in FIG. 3. When transition has been made from step S7, since in the above example the correction note count is 2, the current stored note count becomes the number of notes of the stored note count (99) that was updated at step S10 reduced by the correction note count (2), namely the current stored note count is corrected to a number (97) that includes the subsequent banknote classified at step S6. Accordingly, the actual number of notes stored in the corresponding banknote storage box 8 can be made to match the count value of the stored note count counted in the stored note count counting area.

S13: When the current stored note count has been counted, based on the classification result of the classification section 6 the controller 2 conveys a classified banknote between the classification section 6 and the trigger sensor 16 on the conveyance path 13. The stacking destination is determined when the trigger sensor 16 has detected the banknote, the conveyance direction is switched by the switching mechanism 14*a*, and the banknote is conveyed to the paying in/paying out port 5*a* or the reject box 10 and stacked. After stacking the banknote, the stacking sequence indicator prior to the current stacking sequence indicator and the stacking sequence table serial number data associated therewith are deleted and processing transitions to step S14.

Stacking of the banknotes at the present step is performed as described below.

When a banknote classified as a regular banknote at step S5 is detected by the trigger sensor 16, the controller 2 determines the stacking destination to be the paying in/paying out port 5*a* and the switching mechanism 14*a* switches the conveyance direction of the conveyance path 13 to the direction of the paying in/paying out section 5, and the banknote is conveyed to the paying in/paying out port 5*a* and stacked. The stacked payment note count is counted by increasing by 1 the stacked payment note count for the corresponding denomination in the stacked payment note count counting area of the storage section 3.

Pay-out irregular banknotes that have been classified as pay-out irregular banknotes for example with overlapping conveyance at step S5 and conveyed out from the classification section 6 at step S6 are in essence regular banknotes that are suitable for payment. Since the number of these notes has been counted as the correction note count, when the pay-out irregular banknotes are detected by the trigger sensor 16 the paying in/paying out port 5*a* is determined as the stacking destination, the switching mechanism 14*a* switches the conveyance direction of the conveyance path 13 to the direction of the paying in/paying out section 5, and the pay-out irregular banknotes are conveyed to the paying in/paying out port 5*a* and stacked. The stacked payment note count is counted by increasing the stacked payment note count for the corresponding denomination by the correction note count.

Moreover, the next subsequent banknote classified at step S6 is conveyed to the paying in/paying out port 5*a* and stacked, similarly to the regular banknote described above, and the stacked payment note count is counted by increasing by 1 the stacked payment note count for the corresponding denomination.

Note that when the correction note count that has been counted as the number of pay-out irregular banknotes is 2 or more, and stacking that number of notes at the paying in/paying out port 5*a* would reach the payment note count for the corresponding denomination, then these pay-out irregular banknotes are stacked at the paying in/paying out port 5*a*. The stacked payment note count is counted by increasing the stacked payment note count for the corresponding denomination by the correction note count, and the next subsequent banknote classified at step S6 (including any subsequent banknotes that have been fed out, where present) is stored back in the original banknote storage box 8 by running the conveyance path 13 in reverse. The current stacking sequence indicator is set to the stacking sequence indicator of the next subsequent banknote classified at step S6 and the stored note count is changed by increasing the stored note count by 1.

Moreover, when the correction note count that has been counted as the number of pay-out irregular banknotes is 2 or more, and stacking that number of notes at the paying in/paying out port 5*a* would exceed the payment note count for the corresponding denomination, the stacking destination is determined to be the reject box 10 when the pay-out irregular banknotes are detected by the trigger sensor 16. The switching mechanism 14*a* switches the conveyance direction of the conveyance path 13 to the direction of the reject box 10, and the pay-out irregular banknotes are conveyed to the reject box 10 and stacked. The next subsequent banknote classified at step S6 is stacked at the paying in/paying out port 5*a*, and the stacked payment note count is counted by increasing by 1 the stacked payment note count for the corresponding denomination. In such cases, the current stacking sequence indicator and the stored note count are kept as they are.

Note that configuration may be made whereby the stacking destination of the pay-out irregular banknotes is not set to the reject box 10, and temporary storage is made back in the original banknote storage box 8 by running the conveyance path 13 in reverse, the deficit amount is separated once again and the payment note count's worth of banknotes is stacked at the paying in/paying out port 5*a*. Such configuration enables the banknotes that are stacked in the reject box 10 to be reduced further. Configuration may also be made wherein it is possible to switch between these two processing operations.

S14: Processing returns to step S3 when classified banknotes have been stacked at for example the paying in/paying out port 5*a*, if the stacked payment note count for the corresponding denomination in the stacked payment note count counting area of the storage section 3 is less than the read payment note count for the corresponding denomination (see step S2), and the feeding out operation for the corresponding denomination is continued. Processing transitions to step S15 if the stacked payment note count for the corresponding denomination has reached the read payment note count for the corresponding denomination.

S15: When the payment note count for one denomination has been stacked at the paying in/paying out port 5*a*, the controller 2 computes a stacked amount that is stacked at the paying in/paying out port 5*a*. If the stacked amount is less than the payment amount, processing returns to step S2 and a feeding out operation is performed for the other remaining denominations similarly to as described above. If the stacked amount has reached the payment amount, the shutter of the paying in/paying out port 5*a* is opened and the stacked banknotes are paid to the customer. After removal of the banknotes has been confirmed, the shutter is closed and the current time of pay-out processing is ended.

The processing operation of pay-out processing of the paper currency deposit-withdrawal mechanism 1 of the present exemplary embodiment is performed as described above.

Note that at step S6, when the next subsequent banknote is not fed out due to the number of fed out notes having reached that of the payment note count for the corresponding denomination, the controller 2 feeds out from the corresponding banknote storage box 8 a single uppermost banknote, and the processing operation described above is performed based on the serial number data of this subsequent banknote, the pay-out irregular banknotes are stacked at the paying in/paying out port 5*a*, the stacked payment note count is counted by increasing the stacked payment note count for the corresponding denomination by the correction note count, and the freshly fed out subsequent banknote is stored back in the original banknote storage box 8 by running the conveyance path 13 in reverse. The current stacking sequence indicator is set to the stacking sequence indicator of the freshly fed out subsequent banknote that has been classified at step S6, and the stored note count is changed by increasing the stored note count by 1.

As described above, in the present exemplary embodiment, due to counting the number of pay-out irregular banknotes with conveyance irregularities such as overlapping running and chains during pay-out, pay-out irregular banknotes can be stacked at the paying in/paying out port 5 rather than being stacked at the reject box 10, enabling the number of banknotes fed out from the banknote storage boxes 8 during pay-out to be reduced and an increase in the cash utilization efficiency of the banknote storage boxes 8, and also enabling the pay-out transaction times to be shortened.

Moreover, the count value of the stored note count of the banknote storage boxes 8 can reliably be made to match the actual number of notes, eliminating the need to re-count the stored note counts of the banknote storage boxes 8 during audits, enabling the operation time of audits to be greatly shortened.

As described above, in the present exemplary embodiment the stacking sequence tables that hold the stacking sequence indicators of the banknotes stored in the banknote storage boxes and the serial number data of these banknotes in stacking order are stored in the storage section of the paper currency deposit-withdrawal mechanism. During pay-out, when a banknote fed out from the banknote storage boxes is a pay-out irregular banknotes classified with conveyance irregularities by the classification section, the serial number data of the next subsequent banknote to the pay-out irregular banknotes is detected by the classification section, and the correction note count that is the number of banknotes configuring the pay-out irregular banknotes is counted based on the detected serial number data and the stacking sequence table. The count number of the current stored note count of the banknote storage box is reduced by the correction note count to correct the current stored note count, and the pay-out irregular banknotes counted as the correction note count is conveyed to the paying in/paying out section and stacked, thereby enabling the pay-out irregular banknotes counted with the correction note count to be stacked at the paying in/paying out port. The number of banknotes fed out from the banknote storage boxes during pay-out is reduced, enabling the cash utilization efficiency of the banknote storage boxes to be improved and the pay-out transaction times to be shortened. Moreover, the count value of the stored note count of the banknote storage boxes can reliably be made to match the actual number of notes, eliminating the need to re-count the stored note counts of the banknote storage box during audits, and accordingly enabling the operation time of audits to be greatly shortened.

Second Exemplary Embodiment

Figure 5:
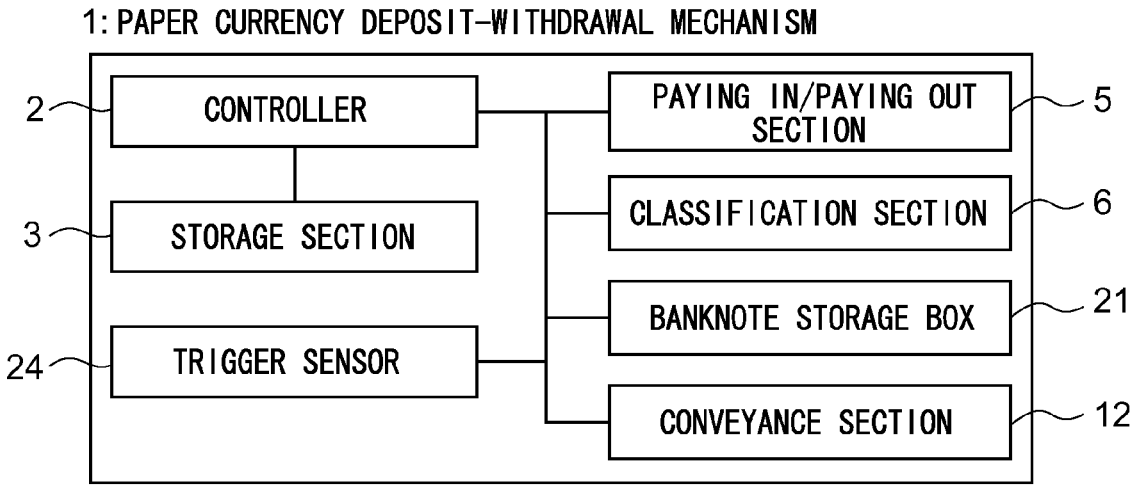
FIG. 5 is a block diagram illustrating a paper currency deposit-withdrawal mechanism of the first exemplary embodiment.
Figure 6:
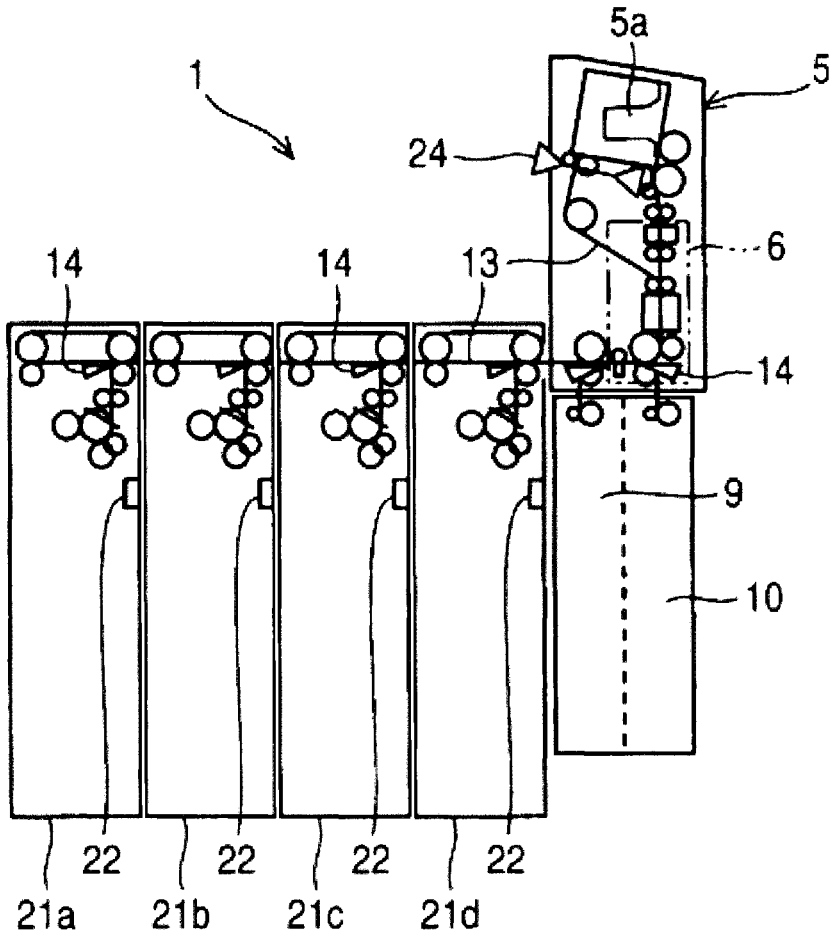
FIG. 6 is an explanatory diagram illustrating a configuration of a paper currency deposit-withdrawal mechanism of the first exemplary embodiment.
Figure 7:
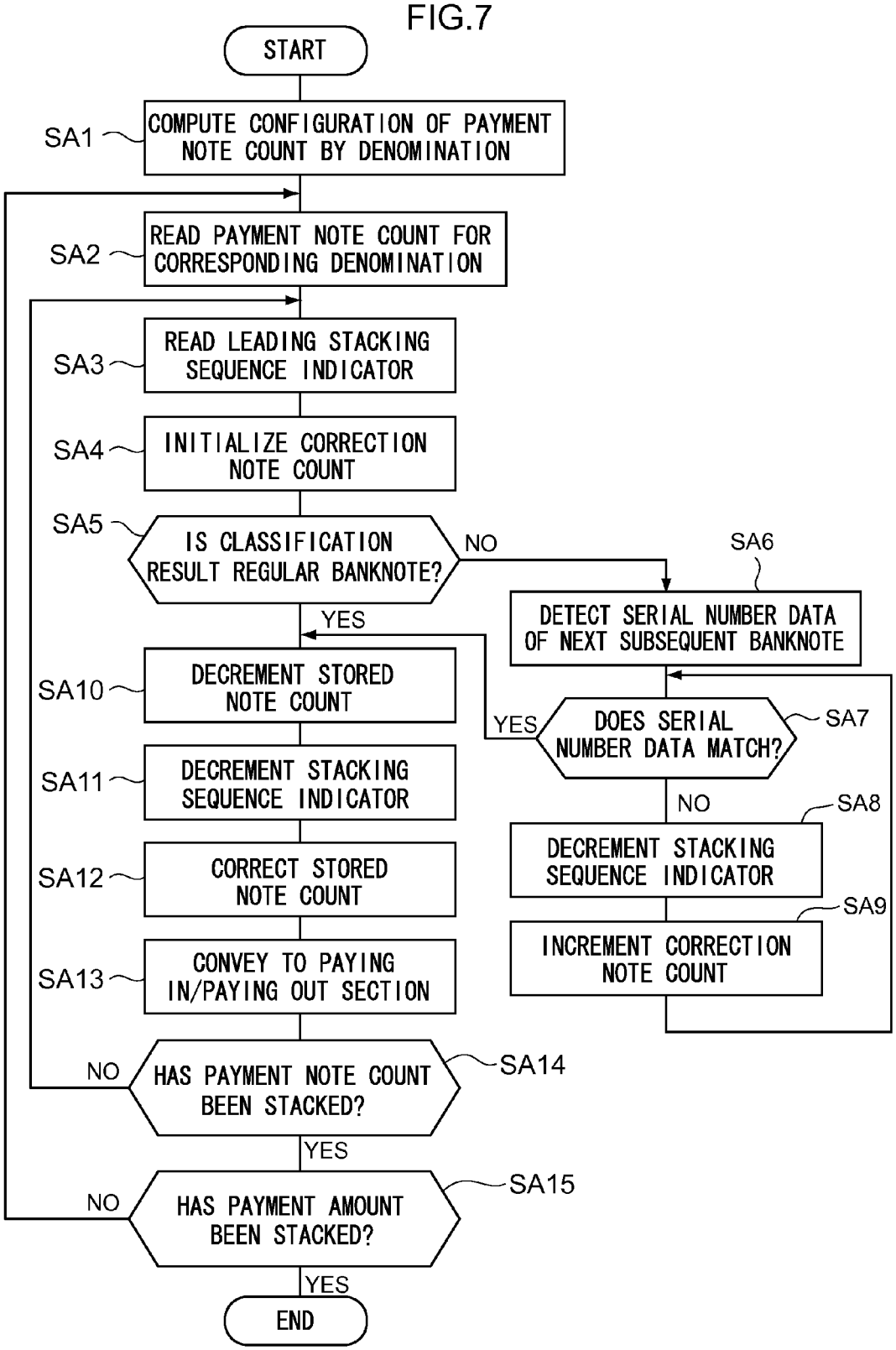
FIG. 7 is a diagram illustrating a flowchart that explains pay-out processing in the second exemplary embodiment.

Explanation follows regarding a paper currency deposit-withdrawal mechanism of the present exemplary embodiment, with reference to FIG. 5 to FIG. 7. Note that elements similar to those of the first exemplary embodiment described above are allocated the same reference numerals and further explanation thereof will be omitted.

As shown in FIG. 5 and FIG. 6, a paper currency deposit-withdrawal mechanism 1 of the present exemplary embodiment is a paper currency deposit-withdrawal mechanism with a simple configuration, with the temporary holding section 7, the top-up and retrieval cassette 11 and the switching mechanism 14*a* of the first exemplary embodiment omitted.

Banknote storage boxes 21 include four storage boxes 21*a* to 21*d*, with a similar function to the banknote storage boxes 8 of the first exemplary embodiment described above. However, as shown in FIG. 6, the banknote storage boxes 21*a* to 21*d* are respectively provided with data storage sections 22 that function to transmit storage data to a controller 2 of the paper currency deposit-withdrawal mechanism 1 either by contact or without contact, and are detachably mounted to the paper currency deposit-withdrawal mechanism 1.

A trigger sensor 24 is a sensor with a banknote detection function similar to that of the trigger sensor 16 of the first exemplary embodiment. During for example pay-out, the trigger sensor 24 detects a timing to make determination as to whether the stacking destination of a banknote classified by a classification section 6 will be a paying in/paying out section 5 or a reject box 10.

Note that the trigger sensor 24 of the present exemplary embodiment is a sensor provided to selectively stack banknotes at a paying in/paying out port 5*a* or at the reject box 10 in an apparatus to which it is not possible to provide the switching mechanism 14*a* of the first exemplary embodiment due to the simplification of the conveyance paths. The trigger sensor 24 is disposed in the immediate vicinity of the paying in/paying out section 5 on the upstream side of the paying in/paying out section 5 in the conveyance direction towards the paying in/paying out section 5, at a position where the conveyance path length from the classification section 6 to the trigger sensor 24 of the conveyance path 13 that connects together the classification section 6 and the paying in/paying out section 5 is longer than the conveyance pitch of banknotes fed out from the banknote storage boxes 21.

The storage section 3 of the paper currency deposit-withdrawal mechanism 1 of the present exemplary embodiment is pre-stored with a service execution program. The service execution program includes a banknote processing program and an irregular banknote count counting program similar to that of the first exemplary embodiment, with an additional storage box data storage program that functions to read storage data of the data storage sections 22 and store the read data in the storage section 3 when the banknote storage boxes 21 are mounted. Each functional means of the paper currency deposit-withdrawal mechanism 1 of the present exemplary embodiment is configured by the steps of the service execution program that is executed by the controller 2.

Moreover, in the storage section 3, as well as storing preset storage denomination setting data similarly to in the first exemplary embodiment, a stored note count counting area, a correction note count counting area, and a stacked payment note count counting area, for example, are also secured in advance, similarly to in the first exemplary embodiment.

The storage section 3 further secures a table storage area for stacking sequence tables (see FIG. 3) for each of the banknote storage boxes 21, similarly to in the first exemplary embodiment.

The data storage sections 22 of each of the banknote storage boxes 21 of the present exemplary embodiment are stored with stacking sequence tables stored with banknote stacking sequence indicators and serial number data of the serial numbers and the serial number colors of these banknotes in stacking sequence, similar to those of the first exemplary embodiment.

Explanation follows regarding operation when topping up banknotes to the banknote storage boxes 21 of the paper currency deposit-withdrawal mechanism 1 of the present exemplary embodiment.

When topping up banknotes to the banknote storage boxes 21 of the present exemplary embodiment, the empty paper currency deposit-withdrawal mechanism 1 is readied, the banknote storage boxes 21 are mounted to a cash handling machine, not shown in the drawings, and banknotes of a denomination set for that banknote storage box 21 are supplied from the cash handing machine and stacked.

While doing so, the cash handing machine generates the stacking sequence table of the stacking sequence indicators and serial number data of the banknotes stacked in the banknote storage box 21, and the stacking sequence table is stored to the data storage section 22 of the banknote storage box 21.

Then, the banknote storage box 21 is mounted to the paper currency deposit-withdrawal mechanism 1, and the controller 2 reads the stacking sequence table from the data storage section 22 of the banknote storage box 21 and stores the read stacking sequence table as the stacking sequence table for the corresponding banknote storage box 21 in a table storage area of the storage section 3.

When performing pay-in processing in a pay-in transaction of the paper currency deposit-withdrawal mechanism 1 of the present exemplary embodiment, on receipt of a pay-in instruction from a higher-level apparatus the controller 2 opens a shutter of the paying in/paying out section 5. When banknotes have been introduced to the paying in/paying out port 5*a*, the shutter is closed and the introduced banknotes in the paying in/paying out port 5*a* are fed out one note at a time and conveyed to the classification section 6 by the conveyance path 13. Based on the denomination of a regular banknote classified as a genuine note and a whole note by the classification section 6, the banknote storage box 21 set for that denomination is designated by referring to the storage denomination setting data of the storage section 3. The banknote is conveyed to the designated banknote storage box 21 by the conveyance path 13 and stored, and a stored note count of the stored banknotes is counted separately for each of the banknote storage boxes 21 in the stored note count counting area of the storage section 3.

While doing so, the controller 2 detects the serial number data of the serial number and number color of the conveyed banknote with the classification section 6, and stores the serial number data associated with the stacking sequence indicator whilst incrementing the stacking sequence indicator of the stacking sequence table of the corresponding banknote storage box 21.

Note that during classification of introduced banknotes, a pay-in reject banknote classified by the classification section 6 as a reject banknote during paying in, for example due to being of indeterminate denomination, or a note that the classification section 6 has classified with conveyance irregularities such as overlapping conveyance, is conveyed from the classification section 6 by the conveyance path 13 in the direction of the paying in/paying out section 5. Then when the banknote has been detected by the trigger sensor 24, the controller 2 determines that the stacking destination is the paying in/paying out section 5, and the conveyance direction is left unchanged and the banknote is conveyed to the paying in/paying out port 5*a* and stacked, and thereby returned to the customer.

A banknote classified as, for example, a damaged note that, although a genuine note for which it is possible to determine the denomination, can nonetheless not be employed for paying out due to for example excessive soiling or excessive damage, is initially conveyed from the classification section 6 by the conveyance path 13 in the direction of the paying in/paying out section 5. However when the banknote is detected by the trigger sensor 24, the controller 2 determines that the stacking destination is the reject box 10 and after briefly stopping the conveyance path 13, the conveyance path 13 is driven in reverse and the banknote is conveyed to the reject box 10 and stacked.

The processing operation of pay-in processing of the paper currency deposit-withdrawal mechanism 1 of the present exemplary embodiment is performed as described above.

As described above, the stacking sequence indicators of the stored banknotes and the serial number data of these banknotes are stored in sequence in the stacking sequence table for the respective banknote storage boxes 21 in the table storage area of the storage section 3.

Explanation follows regarding processing operation of a pay-out processing for payment of banknotes stored in the respective banknote storage boxes 21 to a customer, with reference to the steps indicated by SA in FIG. 7.

The processing operation of step SA1 to step SA12 of the present exemplary embodiment are similar to the processing operation of step S1 to step S12 of the first exemplary embodiment, and so explanation thereof is omitted.

At step SA6, a pay-out irregular banknote is conveyed out to the conveyance path 13 between the classification section 6 and the trigger sensor 24.

SA13: When the current stored note count has been counted, based on the classification result from the classification section 6, the controller 2 conveys the classified banknote on the conveyance path 13 between the classification section 6 and the trigger sensor 24, and when the trigger sensor 24 has detected the banknote the controller 2 determines the stacking destination and conveys the banknote to the paying in/paying out port 5*a* or to the reject box 10 and stacks the banknote. After stacking the banknote, the stacking sequence indicator and the associated serial number data prior to the current stacking sequence indicator is deleted from the stacking sequence table and processing transitions to step SA14.

At the present step, stacking of the banknote is performed as follows.

When a banknote that has been classified as a regular banknote at step SA5 has been detected by the trigger sensor 24, the controller 2 determines the stacking destination to be the paying in/paying out port 5*a* and conveys the banknote as it is in the direction of the paying in/paying out section 5 and stacks the banknote at the paying in/paying out port 5*a*. The stacked payment note count is counted by increasing by 1 the stacked payment note count for the corresponding denomination in the stacked payment note count counting area of the storage section 3.

Pay-out irregular banknotes classified as pay-out irregular banknotes with for example overlapping conveyance at step SA5 and conveyed out from the classification section 6 at step SA6 are in essence regular banknotes that are suitable for payment. Since the number of these notes has been counted as the correction note count, when the pay-out irregular banknotes are detected by the trigger sensor 24 the stacking destination is determined to be the paying in/paying out port 5*a*, the banknotes are conveyed as they are in the direction of the paying in/paying out section 5 and stacked at the paying in/paying out port 5*a*. The stacked payment note count is counted by increasing the stacked payment note count for the corresponding denomination by the correction note count.

Moreover, the next subsequent banknote that has been classified at step SA6 is conveyed to the paying in/paying out port 5*a* and stacked, similarly to the regular banknote described above, and the stacked payment note count is counted by increasing by 1 the stacked payment note count for the corresponding denomination.

Note that when the correction note count that has been counted as the number of pay-out irregular banknotes is two or more, and stacking that number of notes at the paying in/paying out port 5*a* would reach the payment note count for the corresponding denomination, the pay-out irregular banknotes are stacked at the paying in/paying out port 5*a* and the stacked payment note count is counted by increasing the stacked payment note count for the corresponding denomination by the correction note count, and the next subsequent banknote classified at step SA6 (including any subsequent banknotes that have been fed out, where present) is stored back in the original banknote storage box 21 by running the conveyance path 13 in reverse. The current stacking sequence indicator is set to the stacking sequence indicator of the next subsequent banknote classified at step SA6 and the stored note count is changed by increasing the stored note count by 1.

Moreover, in cases in which the correction note count that has been counted as the number of pay-out irregular banknotes is two or more, and stacking that number of notes at the paying in/paying out port 5*a* would exceed the payment note count for the corresponding denomination, when the pay-out irregular banknotes are detected by the trigger sensor 24, the stacking destination is determined to be the reject box 10. After briefly stopping the conveyance path 13, the conveyance path 13 is run in reverse conveying the pay-out irregular banknotes to the reject box 10 and stacking the pay-out irregular banknotes. The next subsequent banknote classified at step SA6 (including any subsequent banknotes that have been fed out, where present) is stored back in the original banknote storage box 21 and the current stacking sequence indicator is set to the stacking sequence indicator of the next subsequent banknote classified at step SA6 and the stored note count is changed by increasing the stored note count by 1. Note that in such cases, at step SA14, processing returns to step SA3 and the feeding out operation is started afresh.

The processing operation of the subsequent steps SA14 and SA15 is similar to the processing operation of steps S14 and S15 of the first exemplary embodiment and so explanation thereof is omitted.

The processing operation of pay-out processing of the paper currency deposit-withdrawal mechanism 1 of the present exemplary embodiment is performed as described above.

As described above, in the present exemplary embodiment the trigger sensor is provided on the upstream side in the immediate vicinity of the paying in/paying out section, and the stacking destination is determined when a banknote has been detected by the trigger sensor. Similar advantageous effects can accordingly be achieved to those of the first exemplary embodiment even with a simple configuration that does not include members such as the top-up and retrieval cassette.

Note that in the present exemplary embodiment, explanation has been given of a case in which the stacking destination is determined when the trigger sensor 24 has detected the pay-out irregular banknotes, however configuration may be made wherein a note for which the stacking destination has been determined to be the reject box 10 is briefly stacked at the paying in/paying out port 5*a*, and then pay-out processing is executed afresh after re-storing all of the banknotes stacked at the paying in/paying out port 5*a* in the banknote storage boxes 21.

In each of the exemplary embodiments described above, explanation has been given wherein the serial number data is configured by the serial number and the serial number color, however the serial number data may be configured by the serial number only. For example in the case of notes issued by the Bank of Japan, there are over 12,960,000,000 serial number combinations, and it would be exceptionally unusual for banknotes having the same serial number to appear in succession amongst the banknotes included in a stored note count.

Moreover, in each of the above exemplary embodiments, explanation has been given of an example of a case in which the paper currency deposit-withdrawal mechanism has been applied to an automatic teller machine, however the paper currency deposit-withdrawal mechanism may also be applied to a service counter terminal (teller machine) installed at a bank service counter.

In each of the above exemplary embodiments, explanation has been given using the example of banknotes, however application may be made to any apparatus that handles a medium that includes data that identifies individuals of that medium similarly to the serial number of a banknote.

The invention claimed is:

1. A paper currency deposit-withdrawal mechanism comprising:

a paying in/paying out section that accepts a banknote introduced by a customer during pay-in and stacks a banknote to be paid out to a customer during pay-out;

a classification section that performs various classifications on a banknote;

a banknote storage box that stores a banknote employed in pay-out;

a conveyance path that conveys a banknote;

a storage section that stores a stacking sequence table that includes, in stacking sequence, a stacking sequence indicator of a banknote stored in the banknote storage box and serial number data of the banknote;

a stored note count counting section that counts a current stored note count of banknotes stored in the banknote storage box;

a detection section that, during pay-out, if a banknote fed out from the banknote storage box is one or more pay-out irregular banknotes classified by the classification section as having a conveyance irregularity, detects the serial number data of a next subsequent banknote following the one or more pay-out irregular banknotes;

a correction note count section that compares the detected serial number data and the serial number data in the stacking sequence table along with the stacking sequence, and counts a number of the banknotes with serial number data not matching the serial number data in the stacking sequence table as a number of the one or more pay-out irregular banknotes;

a correction section that corrects the current stored note count by reducing the count number of the current stored note count of the banknote storage box by the number of the one or more pay-out irregular banknotes; and a conveying and stacking section that conveys the one or more pay-out irregular banknotes for which the correction note count has been counted to the paying in/paying out section with the conveyance path and stacks the one or more pay-out irregular banknotes.

2. The paper currency deposit-withdrawal mechanism of claim 1, further comprising:

a reject box that stacks a reject banknote; and a trigger sensor that is disposed on a conveyance path that connects together the classification section and the paying in/paying out section, and that detects a timing to determine whether a stacking destination of a banknote during pay-out will be the paying in/paying out section or the reject box;

wherein the length of the conveyance path between the trigger sensor and the classification section is longer than a conveyance pitch of banknotes fed out from the banknote storage box.

3. The paper currency deposit-withdrawal mechanism of claim 1, wherein the serial number data includes the serial number and the number color of the serial number of a banknote.

4. The paper currency deposit-withdrawal mechanism of claim 2, wherein the serial number data includes the serial number and the number color of the serial number of a banknote.

5. A paper currency deposit-withdrawal mechanism comprising:

a paying in/paying out section that accepts a banknote introduced by a customer during pay-in and stacks a banknote to be paid out to a customer during pay-out;

a classification section that performs various classification on a banknote;

a banknote storage box that stores a banknote employed in pay-out;

a conveyance path that conveys a banknote;

a storage section that stores a stacking sequence table that includes, in stacking sequence, a stacking sequence indicator of a banknote stored in the banknote storage box and serial number data of the banknote;

a stored note count counting section that counts a current stored note count of banknotes stored in the banknote storage box;

a detection section that, during pay-out, if a banknote fed out from the banknote storage box is one or more pay-out irregular banknotes classified by the classification section as having a conveyance irregularly, detects the serial number data of a next subsequent banknote following the one or more pay-out irregular banknotes;

a correction note count section that, based on the detected serial number data and the stacking sequence table, determines a correction note count that is a number of banknotes corresponding to the one or more pay-out irregular banknotes;

a correction section that corrects the current stored note count by reducing the count number of the current stored note count of the banknote storage box by the correction note count;

a conveying and stacking section that conveys the one or more pay-out irregular banknotes for which the correction note count has been counted to the paying in/paying out section with the conveyance path and stacks the one or more pay-out irregular banknotes, a reject box that stacks a reject banknote; and a trigger sensor that is disposed on a conveyance path that connects together the classification section and the paying in/paying out section, and that detects a timing to determine whether a stacking destination of a banknote during pay-out will be the paying in/paying out section or the reject box;

wherein the length of the conveyance path between the trigger sensor and the classification section is longer than a conveyance pitch of banknotes fed out from the banknote storage box.

6. A paper currency deposit-withdrawal mechanism comprising:

a paying in/pay out section that accepts a banknote introduced by a customer during pay-in and stacks a banknote to be paid out to a customer during pay-out;

a classification section that performs various classifications on banknote;

a banknote storage box that stores a banknote employed in pay-out;

a conveyance path that conveys a banknote;

a storage section that stores a stacking sequence table that includes, in stacking sequence, a stacking sequence indicator of a banknote stored in the banknote storage box and serial number data of the banknote;

a stored note count counting section that counts a current stored note count of banknotes stored in the banknote storage box;

a detection section that, during pay-out, if a banknote fed out from the banknote storage box is one or more pay-out irregular banknotes classified by the classification section as having a conveyance irregularity, detects the serial number data of a next subsequent banknote following the one or more pay-out irregular banknotes;

a correction note count section that, based on the detected serial number data and the stacking sequence table, counts the one or more pay-out irregular banknotes as a correction count;

a reject box that stacks a reject banknote; and a trigger sensor that is disposed on a conveyance path that connects together the classification section and the paying in/paying out section, and that detects a timing to determine whether a stacking destination of a banknote during pay-out will be the paying in/paying out section or the reject box;

wherein the length of the conveyance path between the trigger sensor and the classification section is longer than a conveyance pitch of banknotes fed out from the banknote storage box.

* * * * *